United States Patent [19]

Widdowson

[11] 3,965,693

[45] June 29, 1976

[54] MODULATED THROTTLING VALVE

[75] Inventor: Richard E. Widdowson, Dayton, Ohio

[73] Assignee: General Motors Corporation, Detroit, Mich.

[22] Filed: May 2, 1975

[21] Appl. No.: 574,041

[52] U.S. Cl. ..... 62/217; 137/491

[51] Int. Cl.[2] ..... F16K 31/12; F25B 41/04

[58] Field of Search ..... 62/217, 224; 137/491

[56] References Cited

UNITED STATES PATENTS

| | | | |
|---|---|---|---|
| 3,525,234 | 8/1970 | Widdowson | 62/217 |
| 3,744,268 | 7/1973 | Widdowson | 62/217 |

*Primary Examiner*—William E. Wayner

*Attorney, Agent, or Firm*—Kenneth H. MacLean, Jr.

[57] ABSTRACT

An automatically modulated suction throttling valve for an air conditioning system which during relatively high ambient temperature conditions maintains a first pressure level in the evaporator and during lower ambient temperature conditions maintains a higher second pressure level in the evaporator. The throttling valve includes a reciprocal piston valve movable in response to the difference between suction pressure and evaporator pressure to throttle refrigerant flow and maintain the evaporator pressure at a level to prevent frost formation. Pressure responsive means are provided to exert supplemental closing force on the piston valve to increase the evaporator pressure in response to decreasing suction line pressure.

4 Claims, 4 Drawing Figures

MODULATED THROTTLING VALVE

This invention relates to a throttling valve for an air conditioning system and more particularly to an automatically modulated suction throttling valve which in response to a decreasing suction line pressure produces a higher evaporator control pressure and temperature.

The subject automatically modulated suction throttling valve is an improvement over the earlier POA-suction throttling valve disclosed in U.S. Pat. No. 3,525,234 to Widdowson which issued Aug. 25, 1970. The Widdowson patent discloses a suction throttling valve of the type presently used in many General Motors automobiles. This valve includes an evacuated bellows with an interconnected bleed valve to produce a relatively constant control pressure on one side of a reciprocal throttling valve. The evaporator pressure acts upon the other side of the valve to produce valve activation by the pressure differential thereacross. When the pressure differential exceeds the spring force on the reciprocal valve, the valve is moved to pass refrigerant between the evaporator and the compressor inlet.

The Widdowson suction throttling valve is well suited for an air conditioning system proportioned to provide a rapid cool down of an automobile interior when the ambient temperature is relatively high (91° – 115° F. with full sun load). For these conditions, the size of the evaporator and the capacity of the compressor are selected to provide a relatively large cooling capacity. However, during operation under low ambient temperature conditions (less than 80° F.) the compressor's pumping capacity may greatly exceed the need for adequate cooling. Under both high and low ambient temperature conditions, the Widdowson throttling valve operates to maintain a predetermined evaporator pressure corresponding to a refrigerant temperature needed to prevent frost from forming on the exterior surface of the evaporator. During high ambient temperature conditions, the compressor's pumping capacity and the evaporator's cooling capacity are operating at maximum efficiency with the compressor supplying all it can pump and the evaporator vaporizing all the liquid refrigerant it can get. The pressure of refrigerant in the evaporator exerts a sufficient pressure on the reciprocal throttling valve to maintain it in a fully open position.

During moderate and low ambient temperature operation, there is an excess of compressor capacity over what is needed to provide adequate cooling. The resultant is an excess of liquid refrigerant delivered to the evaporator over the quantity which may be vaporized by heat adsorption from the air. This lowers the evaporator pressure to a level approaching the control pressure of the suction throttling valve which is established by the bellows. The decreased pressure differential permits the reciprocal valve of the suction throttling valve to be moved by a spring toward a more closed position to throttle refrigerant flow and increase the refrigerant pressure in the evaporator. It should be noted that the Widdowson type throttling valve always attempts to maintain the evaporator's internal pressure at one level under both high and low ambient temperature conditions. During low ambient temperature operation of the air conditioning system, throttling of refrigerant flow from the evaporator to the compressor reduces the power needed to operate the air conditioning system and increases fuel economy. The relatively cold temperature level maintained by the Widdowson valve may be unnecessary for sufficient cooling of the passenger compartment during low ambient temperature operation of the air conditioning system.

The subject automatically modulated throttling valve controls evaporator pressure at an increasing pressure level with decreasing suction line pressures. The suction pressure decreases as ambient temperatures decrease and therefore the modulated throttling valve tends to maintain a greater evaporator pressure and temperature during low to moderate ambient temperature operation. Resultingly, the throttling valve is closed a greater percentage of the time under these conditions and the torque and power input to the compressor is reduced during low ambient temperature conditions. While the vehicle's fuel economy is enhanced by increased throttling, cooling of a passenger compartment is not significantly reduced since the heat transfer required at these lower ambient temperatures is much less than the maximum capacity of the evaporator and corresponding pumping capacity of the compressor.

Therefore, an object of the present invention is to provide an automatically modulated suction throttling valve for an air conditioning system to maintain the pressure of the evaporator at a first level during high ambient temperature operation and at a second and greater internal pressure under low ambient temperature operation.

A further object of the present invention is to provide an automatically modulated suction throttling valve for an air conditioning system including pressure responsive means in the form of a modulating piston movable in response to decreasing suction pressures to exert a closing force on the throttling valve and thereby increasing throttling action and maintaining a higher pressure level in the evaporator.

Further objects and advantages of the present invention will be more readily apparent from the following detailed description, reference being had to the accompanying drawings in which a preferred embodiment is illustrated.

THE REFRIGERANT SYSTEM

Figure 1:
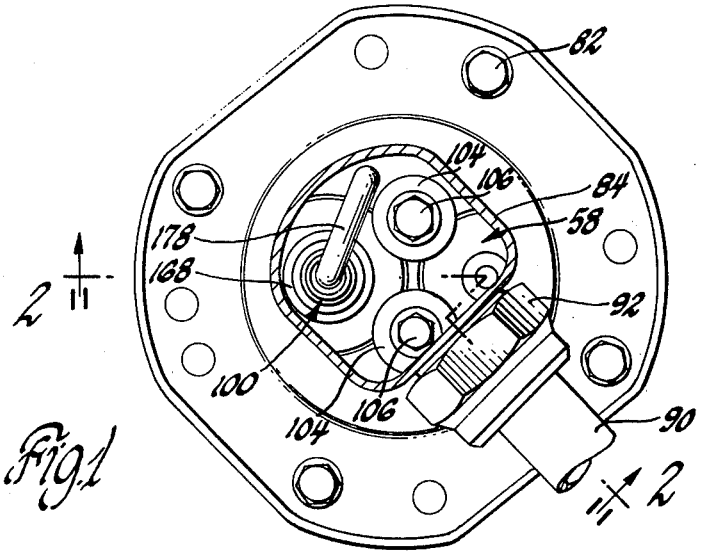
FIG. 1 is a top view of a receiver combined with an expansion valve and the subject improved throttling valve adapted for use in an automobile air conditioning system.
Figure 2:
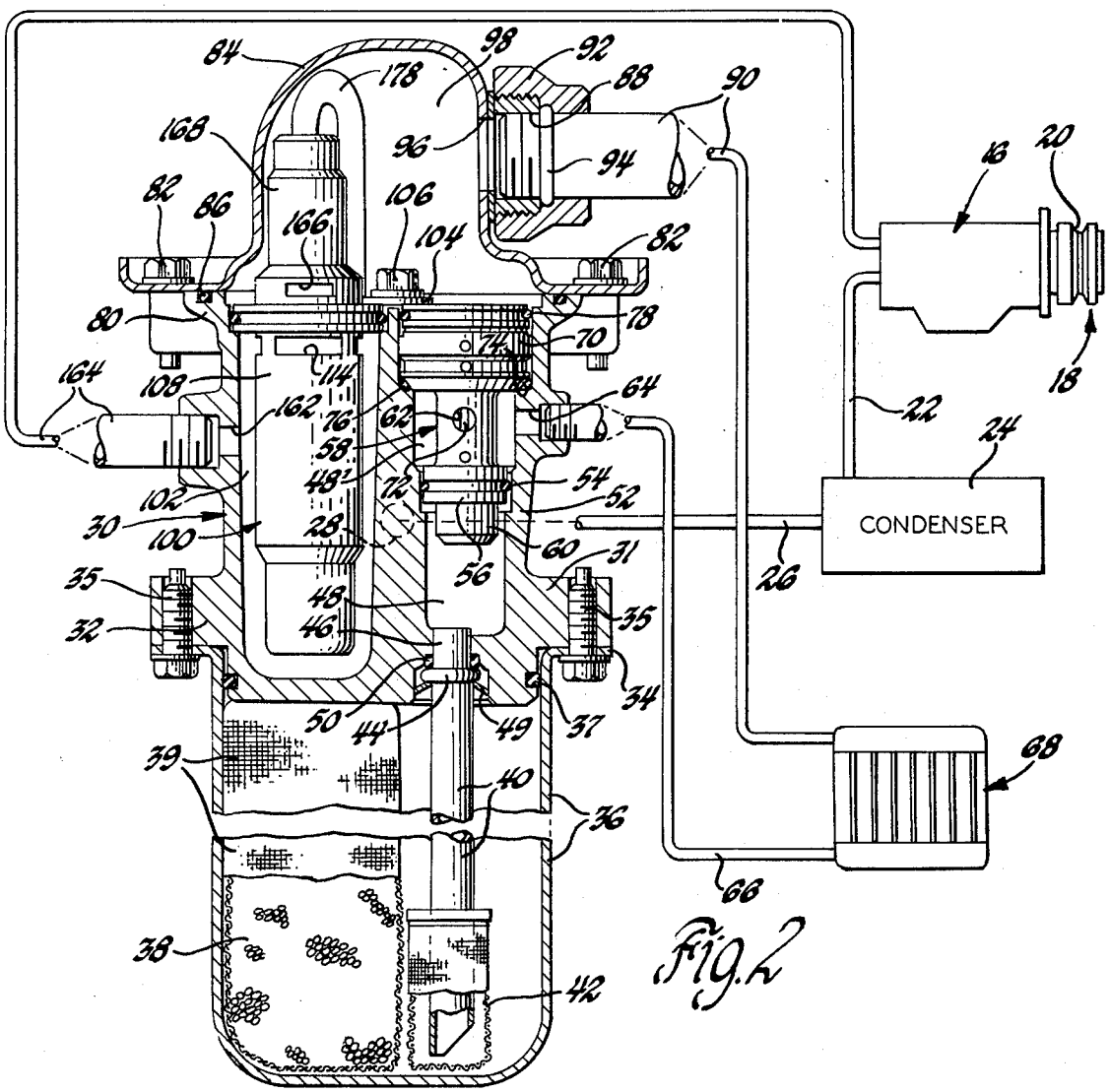
FIG. 2 is a vertical sectioned view of the receiver and valve assembly shown in FIG. 1 taken along section line 2—2 and looking in the direction of the arrows.

Referring now more particularly to FIGS. 1 and 2, there is shown a receiver containing a thermostatic expansion valve and suction throttling valve similar to the assembly disclosed in the aformentioned Widdowson patent. Specifically, there is a refrigerating system including a compressor 16, diagrammatically illustrated, whose output shaft is connected to an electromagnetic clutch assembly 18. The clutch assembly 18 has a grooved pulley 20 adapted to be rotated by an automobile engine through a V-type belt. The compressor outlet is connected by a conduit 22 to a condenser 24 which has its outlet connected by the conduit 26 to the entrance 28 of the unitary structure 30 which houses the valve and the connections between them as well as a dessicant and a receiver. The entrance 28 forms the inlet to a passage in the aluminum casting 31 (not visible). The casting 31 has a shoulder 32 extending around its bottom end to which is attached an outwardly extending flange portion 34 of a cup-shaped container 36 by fasteners 35. The interior of container 36 defines a receiver space for the storage of a surplus quantity of refrigerant. An O-ring 37 between the casting 31 and the container 36 prevents a refrigerant leakage therefrom. Also included in the interior of container 36 is a dessicant 38 contained in a porous enclosure or bag 39 which serves as a dehydrator for the refrigerant.

Extending substantially to the bottom of the cup-shaped member 36 is a vertical tube 40 having an entrance at the bottom which is enclosed by a fine wire screen 42. The vertical tube is provided with an enlarged diameter shoulder 44 and a projection 46 which extends up into the vertical chamber 48 which is formed in the housing 30. A radially expandible retainer 49 secures tube 40 to casting 31. Also, an O-ring seal 50 around the tube 40 prevents fluid leakage therebetween. The chamber 48 is provided with a restricted annular portion 52 which forms a seal in cooperation with the O-ring 54 upon the lower portion 56 of the movable thermostatic expansion valve 58. This thermostatic expansion valve 58 has a passage extending axially through the body which meets a transverse outlet passage 62 to provide communication with the outlet 64 in housing 30. The outlet 64 is directly communicated with the liquid line 66 connected with the inlet of the evaporator 68. For further details of a preferred embodiment of the thermostatic expansion valve shown in FIG. 2, reference is made to the aforementioned Widdowson patent.

The thermostatic expansion valve 58 has an enlarged upper portion 70 containing an operating diaphragm with a central portion resting upon an operating pin 72 which is visible through the outlet passage 62. The pin 72 is operably connected to an expansion valve member so that when it is moved downward, refrigerant will flow from the lower portion of chamber 48 through the body 60, out passage 62 and into the outlet 64. The upper portion 70 defines a chamber above the diaphragm which contains a small quantity of adsorbent material such as activated charcoal. This forms a temperature responsive enclosure containing a suitable refrigerant which is adsorbed and evolved from the adsorbent as the temperature falls and rises. This causes the diaphragm within the upper portion 70 to move upwardly and downwardly to position pin 72 and the interconnected expansion valve in a suitable position to supply desirable quantities of refrigerant to the evaporator 68.

The removable thermostatic expansion valve 58 has a beveled shoulder 74 which seals itself against an O-ring 76 in the upper part of the chamber 48. Above the shoulder 74 there is provided a groove containing a second O-ring seal 78 to prevent refrigerant leakage thereby. On the upper end of member 31, a flange portion 80 is provided to which is attached by fasteners 82 a removable cup-shaped member 84. An O-ring type seal 86 prevents fluid leakage therebetween. The wall member 84 is provided with an inlet connection 88 connected to the suction line 90 extending from the top of the evaporator 68. A threaded fastener member 92 engages an enlarged portion 94 of the suction line 90 to provide a fluid tight connection between suction line 90 and inlet 88. An opening 96 in wall member 84 permits refrigerant to flow from the evaporator 68 into the interior 98 defined by removable wall member 84. The interior 98 of wall portion 84 provides for free fluid flow over the upper parts of the suction throttling valve 100 and the expansion valve 58. Through the flow of refrigerant vapor from the evaporator into chamber 98, the temperature of the adsorbent and refrigerant within portion 70 of expansion valve 58 controls the position of pin 72 and the attached expansion valve and regulates the flow of refrigerant into the evaporator. The wall 84 when removed provides access to the valves 58, 100 and to the vertical chamber 102 which contains the lower portion of the throttling valve 100. The thermostatic expansion valve 58 and suction throttling valve 100 are held within cavities 48 and 102 by washer members 104 and fasteners 106.

Figure 3:
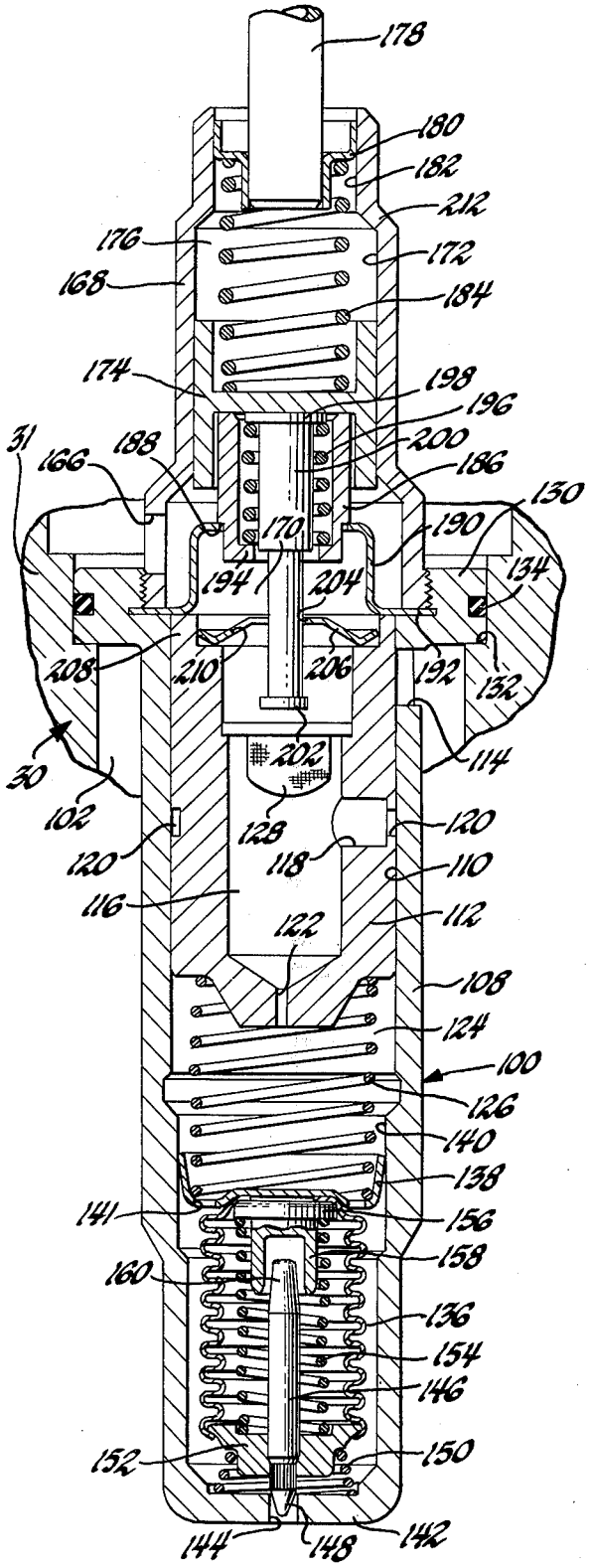
FIG. 3 is an enlarged fragmentary sectioned view of the subject modulated throttling valve shown during one mode of operation.
Figure 4:
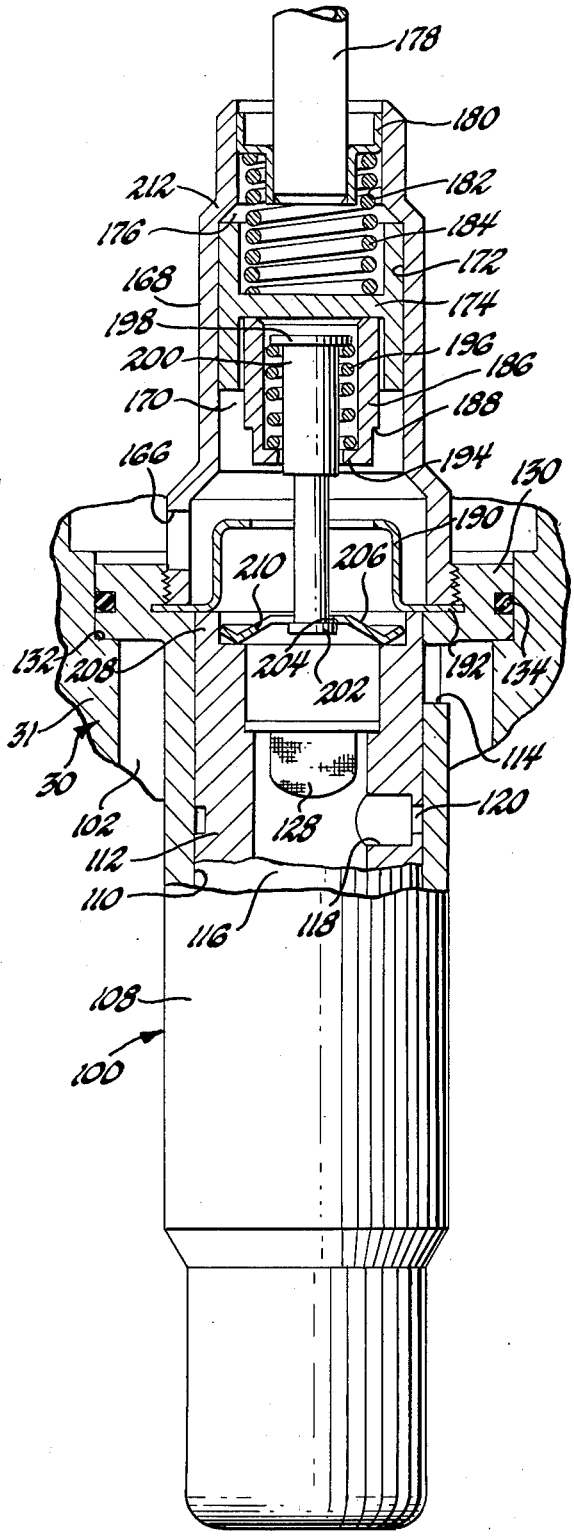
FIG. 4 is a view similar to FIG. 3 but showing the throttling valve in a second mode of operation during low ambient temperature operation.

The throttling valve 100 fits into the vertical cavity 102 which is parallel to the thermostatic expansion valve 58 in its cavity 48. The suction throttling valve 100 is best shown in FIGS. 3, 4 and includes a one-piece, cup-shaped housing 108 containing an enlarged bore 110 which slidably receives a piston valve 112. This piston valve 112 is adapted to cover and uncover ports 114 in the side walls of the housing 108. The piston valve 112 contains a central recess 116 having side outlets 118 connected by an annular groove 120 to the interface between the valve 112 and the housing 108 to provide a lubricating film therebetween for smooth operation of valve 112 within the housing 108. A restricted passage 122 in the piston valve 112 extends from recess 116 to a spring chamber 124 which contains a supporting coil spring 126 beneath the piston valve 112. The spring 126 together with the pressure force in the spring chamber 124 controls the position of piston 112 in conjunction with the pressure force applied to the top of the piston. The recess 116 in piston 112 is covered by a concave fine screen 128 which stops the flow of any particles in the refrigerant. The valve housing 108 is supported by an annular upper flange 130 resting upon an annular shoulder 132 and refrigerant is prevented from flowing therebetween by an O-ring 134.

The pressure in spring chamber 124 is regulated by movement of a sealed bellows 136 located beneath the spring chamber 124. The top of the bellows 136 is supported by and bonded to a cup-shaped and perforated support 138 which is press fit within the bore 140 which is coaxial and aligned with the bore 110. The support 138 also serves as a lower spring retainer for the bottom of spring 126 and has openings 140 therein to permit refrigerant flow therethrough. The housing 108 is provided with a bottom closing wall 142 containing an outlet opening or bleed 144. A needle valve 146 has a cone-shaped lower end 148 which is adapted to extend into opening 144 to control refrigerant flow therethrough. The bottom wall 142 holds one end of a weak coil spring 150 which contacts the end 152 of bellows 136. The bellows 136 contains an interior spring 154 which extends between end 152 and an internal spring retainer 156. Retainer 156 has an axially extended tubular portion 158 which surrounds the upper end 160 of the needle valve 146 which is supported by the bellows end 152. Valve 146 extends through end 152 into the bellows interior a sufficient distance to serve as an internal stop. The upper end of valve 146 engages the spring retainer 156 when the bellows is partially collapsed to prevent its complete collapse.

The internal spring 154 within bellows 136 together with the spring action of the bellows itself and the weak coil spring 150 determine the pressure at which the bellows 136 will contract and move end 148 of needle valve 146 away from the bottom wall 142. The collapsing pressure of the bellows 134 is selected to cause the bleed valve 146 to close opening 144 whenever the pressure and corresponding temperature within the evaporator falls substantially below the freezing point of water. This pressure and temperature is determined by the temperature at which frosting of the evaporator begins under adverse operating conditions. A suitable setting is about 29 to 30 pounds gauge or 43.2 to 44.2 pounds per square inch absolute for R-22 refrigerant (CHCLF2, monochlorodifluoromethane). The vertical chamber 102 encircling valve 100 is provided with an outlet 162 which is fluidly connected through the suction conduit 164 with the inlet of the compressor 16.

OPERATION

Hot compressed refrigerant is discharged from the compressor 20 to pass through the conduit 22 to the condenser 24 where the refrigerant liquifies and flows through the conduit 26 to entrance 28 for flow into the reservoir 36. The refrigerant is dehydrated by contact with the dessicant 38 in the receiver and hence flows upward through the screen 42, the tube 40, the chamber 48 and into the bottom of the chamber 48. Refrigerant then flows through thermostatic expansion valve 58 into the annular chamber 48' to outlet 64. The refrigerant then flows from outlet 64, through conduit 66 to the evaporator 68 where the liquid refrigerant is vaporized and passes through the conduit 90 to the interior 98 of the removable wall member 84. Next refrigerant flows through the inlet ports 166 in the upper housing portion 168 of the suction throttling valve 100. In the throttling valve 100, the piston 112 is depressed by the excess of pressure force of refrigerant in the chamber 170 above the piston over the force of spring 126 and the pressure on the bottom of piston 112. When the piston 112 moves downward sufficiently to uncover the outlet ports 114, refrigerant is discharged from the evaporator and the internal pressure of the evaporator tends to decrease slightly. The pressure force of fluid in spring chamber 124 acting against the bottom of piston valve 112, the pressure force in the chamber 170 on the top of piston valve 112 and the force of spring 126 combine to control the position of the piston valve 112 and maintain the pressure within the evaporator 68 by regulating the refrigerant flow through port 114.

The needle valve 146 which is controlled by the bellows 136 and its spring 154 maintains a substantially constant control pressure within chamber 124 by the bleed of refrigerant through opening 144. This assures the maintenance of a relatively constant pressure in chamber 170 above the piston valve 112 during moderate and low ambient temperature operation. Since piston valve 112 is located between evaporator 68 and suction conduit 64, the chamber 102 downstream from port 114 is at a pressure lower than the evaporator under most operating conditions. The restricted orifice 122 in piston valve 112 permits a limited quantity of refrigerant to flow through the chamber 124 and opening 144 to chamber 102 whenever needle valve 146 is open. This permits the bellows control 136 to be washed with evaporator refrigerant and to constantly readjust its position to maintain the desired predetermined control pressure within chamber 124.

The aforementioned suction throttling valve operates in a satisfactory manner over a wide range of ambient temperature conditions. However, as previously explained, the compressor and evaporator components are designed and selected to provide for a maximum cooling condition under adverse ambient temperature conditions. Consequently, the evaporator has an excess of cooling capacity and the compressor has an excess of pumping capacity than is needed for the most desirable operation during low and moderate ambient temperature conditions. Therefore, the subject improved throttling valve provides for modulated operation of the suction throttling valve as follows. A cylinder bore 172 is formed in the upper housing 168 above the chamber 170. A modulating piston 174 is slidably supported for reciprocation within the bore 172 in response to pressure differentials between refrigerant in chamber 170 and in chamber 176 located above the modulating piston 174. The chamber 176 is fluidly connected by a conduit 178 to the annular space 102 which is fluidly connected to the suction line 164. An adjustable cap or connector 180 has a reduced diameter portion adapted to be crimpingly attached to the end of conduit 178 to prevent fluid leakage therebetween. The outer enlarged surface of the adjustment cap 180 is press fitted in bore 182 in the upper end of housing 168. A coil spring 184 extends between the top surface of piston 174 and the adjustment cap 180 to exert a downward force on the piston 174 and thereby maintain it in the normal operating position shown in FIG. 3. The force of spring 184 upon piston 174 is conveniently adjusted during assembly by varying the depth of the seating means of adjustment cap 180.

A combination stop member and spring retainer 186 is attached to the bottom of piston 174. A shoulder 188 formed on the stop member to limit downward movement of piston 174 by engagement with a piston baffle strap 90 which has radially outwardly extending portions 192 which are secured at a peripheral edge between housing portions 108 and 168. The baffle 190 is not of annular configuration and thereby does not interfere with the flow of refrigerant from inlet 166 to the outlet port 114. The outer edge of baffle 190 also serves the function of limiting upward movement of piston 112 as shown in FIG. 3.

The combination stop member and spring retainer 186 has an inwardly turned lower edge 194 which secures the bottom end of a modulator spring 196. The upper end of the spring 196 engages the underside of an enlarged diameter head 198 of a pin 200 to permit the pin to move downward from piston 174 against the force of spring 196. A second head end portion 202 on the lower end of the pin 200 extends through an opening 204 in a retainer 206 whose outer peripheral edge is biased by natural spring action against the end 208 of the piston 112. Opening 204 is elongated and widened at the leftward end as shown by the numeral 210 to permit the enlarged head 202 to be inserted during assembly.

When suction pressure decreases, the enlarged head 202 is moved upward and finally engages the bottom surface of the retaining ring 206 as shown in FIG. 4, which discloses the position assumed by piston 174 when the upward force caused by the differential between the evaporator pressure in chamber 170 and the suction pressure in space 102 exceeds the force of spring 184 to permit the modulator piston 174 to move upward. More particularly, in the preferred embodiment disclosed, the modulator piston 174 is permitted to move upward 15 millimeters from the position shown in FIG. 3 to the position shown in FIG. 4. The distance between the upper surface of head 202 and the bottom of retainer ring 206 is only about 12.5 millimeters in FIG. 3. Therefore, as shown in FIG. 4, when the piston 174 is moved 15 millimeters against the shoulder 212 of housing 168, the engagement between head 202 and the retainer ring 206 compresses spring 196 about 2.5 millimeters and places an initial preload upon the throttling piston 112 tending to maintain it in a closed position. As a consequence of the preload, a greater pressure differential between chamber 170 and control chamber 124 is needed to open piston 112 and unblock the outlet port 114. Thus, the illustrated arrangement including piston 174, pin 200 and spring 196 effectively increases the internal pressure of the chamber 170 and the connected evaporator in response to decreasing suction pressure. Resultantly, the evaporator operates at a higher pressure when the modulator piston is moved upward toward the position shown in FIG. 4. The increase in evaporator pressure is determined by the preload of the modulator spring on the piston. The increased throttling action in turn produces a lower suction pressure at the compressor inlet which reduces the input power requirements of the compressor.

Although the drawings disclose a preferred embodiment, other embodiments may be adapted without being outside the scope of the following claims which define the invention.

What is claimed is:

1. A suction throttling valve for regulating the pressure conditions within an evaporator unit of an automobile air conditioning system wherein the evaporator unit is connected in refrigerant flow relationship with a condenser, expansion means and an engine driven compressor comprising: a housing having an inlet and an outlet connected respectively to the evaporator and the compressor; a flow throttling assembly supported in said housing between said inlet and outlet for controlling the discharge of refrigerant from said evaporator so as to maintain the evaporator internal pressure above a level corresponding to frost forming conditions thereon; said flow throttling assembly including a body having a bore therein in which is reciprocally supported a piston valve whose movements cover and uncover a port in said body thereby controlling refrigerant flow; one side of said piston valve being fluidly exposed to evaporator refrigerant and a pressure control chamber formed on the opposite side of said piston valve; means to maintain a relatively constant pressure in said control chamber whereby a pressure differential across said piston valve produces a net force thereon to position the piston valve and thus regulate evaporator pressure by controlling the discharge of refrigerant through said port; means including a second piston reciprocal against a spring in response to decreasing refrigerant pressure downstream from said port to impose a supplementary closing force on said piston valve to permit evaporator pressure acting on said one side of the piston valve to increase substantially by reduced flow past said piston valve and through said port whereby the desirable consequence of reduced refrigerant flow to the compressor is decreased energy input.

2. A suction throttling valve for regulating the pressure conditions within an evaporator unit of an automobile air conditioning system wherein the evaporator unit is connected in refrigerant flow relationship with a condenser, expansion means and an engine driven compressor comprising: a housing having an inlet and an outlet connected respectively to the evaporator and the compressor; a flow throttling assembly supported in said housing between said inlet and outlet for controlling the discharge of refrigerant from said evaporator so as to maintain the evaporator internal pressure above a level corresponding to frost forming conditions thereon; said flow throttling assembly including a body having a bore therein in which is reciprocally supported a piston valve whose movements cover and uncover a port in said body thereby controlling refrigerant flow; one side of said piston valve being fluidly exposed to evaporator refrigerant and a pressure control chamber formed on the opposite side of said piston valve; means to maintain a relatively constant pressure in said control chamber whereby a pressure differential across said piston valve produces a net pressure force thereon to position the piston valve and thus regulate evaporator pressure by controlling the discharge of refrigerant through said port; means responsive to decreasing refrigerant pressure downstream from said port to impose a supplemental closing force on said piston valve which permits refrigerant pressure upstream from said piston valve to increase by reduced flow past said piston valve and through said port; said flow throttling body having a second bore aligned with said first bore; a second piston reciprocally supported in said second bore with one side exposed to evaporator refrigerant pressure and another side exposed to refrigerant pressure downstream from said port; a first spring urging said second piston in one direction toward a first operative position and resisting movement of said second piston in a second direction to a second operative position which occurs in response to a net pressure force on said second piston in said second direction produced by increased evaporator pressures and decreased pressure downstream from said port; connecting means between said pistons permitting independent movement of said first piston when said second piston is in its first operative position and imposing said supplemental closing force on said first piston when said second piston is moved to its second operative position.

3. A suction throttling valve for regulating the pressure conditions within an evaporator unit of an automobile air conditioning system wherein the evaporator unit is connected in refrigerant flow relationship with a condenser, expansion means and an engine driven compressor comprising: a housing having an inlet and an outlet connected respectively to the evaporator and the compressor; a flow throttling assembly supported in said housing between said inlet and outlet for controlling the discharge of refrigerant from said evaporator so as to maintain the evaporator internal pressure above a level corresponding to frost forming conditions thereon; said flow throttling assembly including a body having a bore therein in which is reciprocally supported a piston valve whose movements cover and uncover a port in said body thereby controlling refrigerant flow; one side of said piston valve being fluidly exposed to evaporator refrigerant and a pressure control chamber formed on the opposite side of said piston valve and means to maintain a relatively constant pressure in said control chamber whereby a pressure differential across said piston valve produces a net force thereon to position the piston valve and thus regulate evaporator pressure by controlling the discharge of refrigerant through said port; means responsive to decreasing refrigerant pressure downstream from said port to impose a supplemental closing force on said piston valve which permits refrigerant pressure upstream from said piston valve to increase by reduced flow past said piston valve and through said port; said flow throttling body having a second bore aligned with said first bore; a second piston reciprocally supported in said second bore with one side exposed to evaporator refrigerant pressure and said another side exposed to refrigerant pressure downstream from said port; a first spring urging said second piston in one direction toward a first operative position and resisting movement of said second piston in a second direction to a second operative position which occurs in response to a net pressure force on said second piston in said second direction produced by increased evaporator pressures and decreased pressure downstream from said port; connecting means between said pistons permitting independent movement of said first piston when said second piston is in its first operative position and imposing said supplemental closing force on said first piston when said second piston is moved to its second operative position; said connecting means including an elongated member extending between said pistons the upper end of which engages a second spring supported by said second piston which is compressed as said second piston moves to its second operative position and the lower end of which slidably extends through an opening in a portion of said first piston and engages said first piston to form a connection only after partial movement of said second piston to its second operative position whereafter opening movements of said first piston further compress said second spring and resultantly require a greater pressure differential between said evaporator and said control chamber.

4. A suction throttling valve for regulating the pressure conditions within an evaporator unit of an automobile air conditioning system wherein the evaporator unit is connected in refrigerant flow relationship with a condenser, expansion means and an engine driven compressor comprising: a housing having an inlet and an outlet connected respectively to the evaporator and the compressor; a flow throttling assembly supported in said housing between said inlet and outlet for controlling the discharge of refrigerant from said evaporator so as to maintain the evaporator internal pressure above a level corresponding to frost forming conditions thereon; said flow throttling assembly including a body having a bore therein in which is reciprocally supported a piston valve whose movements cover and uncover a port in said body thereby controlling refrigerant flow; one side of said piston valve being fluidly exposed to evaporator refrigerant and a pressure control chamber formed on the opposite side of said piston valve; means to maintain a relatively constant pressure therein whereby a pressure differential across said piston valve produces a net force thereon to position the piston valve and thus regulate evaporator pressure by controlling the discharge of refrigerant through said port; means responsive to decreasing refrigerant pressure downstream from said port to impose a supplemental closing force on said piston valve which permits refrigerant pressure upstream from said piston valve to increase by reduced flow past said piston valve and through said port; said flow throttling body having an end portion with a second bore therein aligned with said first bore; a second piston reciprocally supported in said second bore with the end nearest said first piston being exposed to evaporator pressure; a second end of said second piston defining an interior space with said body portion; conduit means extending from said interior space to the portion of said body downstream of said port to conduct refrigerant pressure therebetween; a connector encircling said conduit means and being press fit into a third bore of said body extending into said interior space opposite the second side of said second piston; a spring within said interior space one end of which engages said second side of said second piston, the other end of which engages said conduit connector whereby the resultant force of said spring on said second piston may be externally changed by moving said press fit connector within said third bore.

* * * * *